US009388559B2

(12) United States Patent
Robertson

(10) Patent No.: US 9,388,559 B2
(45) Date of Patent: Jul. 12, 2016

(54) DEVICE FOR FILTERING DEBRIS IN A GUTTER DOWNSPOUT AND RELATED METHOD

(71) Applicant: Downspout Defender, LLC, Raleigh, NC (US)

(72) Inventor: Dennis Manuel Robertson, Raleigh, NC (US)

( * ) Notice: Subject to any disclaimer, the term of this patent is extended or adjusted under 35 U.S.C. 154(b) by 0 days.

(21) Appl. No.: 14/677,365

(22) Filed: Apr. 2, 2015

(65) Prior Publication Data

US 2015/0284941 A1 Oct. 8, 2015

Related U.S. Application Data

(60) Provisional application No. 61/974,403, filed on Apr. 2, 2014.

(51) Int. Cl.
*E03F 1/00* (2006.01)
*E04D 13/076* (2006.01)

(52) U.S. Cl.
CPC ..... *E03F 1/00* (2013.01); *E04D 13/0767* (2013.01); *Y10T 29/49826* (2015.01)

(58) Field of Classification Search
CPC ..... E03F 1/00; E04D 13/0767
USPC ..... 52/12, 14, 16; 210/162
See application file for complete search history.

(56) References Cited

U.S. PATENT DOCUMENTS 1,366,384 A 5/1919 Hotz
4,615,153 A 10/1986 Carey
5,103,601 A * 4/1992 Hunt ..... E04D 13/076 210/474
5,234,582 A 8/1993 Savoie
5,242,591 A * 9/1993 Beechert ..... E04D 13/076 210/474
5,403,474 A 4/1995 Emery
5,409,602 A * 4/1995 Sorenson ..... B01D 35/02 210/162
5,535,554 A * 7/1996 Harris, Jr. ..... E04D 13/0409 210/474
5,536,406 A * 7/1996 Silva ..... B01D 29/33 210/460
RE36,343 E * 10/1999 Silva ..... B01D 29/33 210/460
5,960,590 A * 10/1999 Hutchison ..... E04D 13/076 210/474
D425,182 S * 5/2000 Vargas ..... D23/260
6,193,880 B1 2/2001 Bergeron
7,407,574 B2 8/2008 Robinson
7,854,838 B2 12/2010 Martin
8,475,654 B1 7/2013 Smith
8,646,217 B2 * 2/2014 Ratajac ..... E04D 13/0725 52/11
2004/0006927 A1 * 1/2004 Wickett ..... E04D 13/076 52/12
2005/0109693 A1 5/2005 Allard
2006/0191208 A1 * 8/2006 MacIntyre ..... E04D 13/0767 52/12
2006/0278573 A1 12/2006 Robinson
2015/0143756 A1 * 5/2015 Higginbotham ..... E04D 13/076 52/12

* cited by examiner

*Primary Examiner* — Brian Glessner
*Assistant Examiner* — Paola Agudelo
(74) *Attorney, Agent, or Firm* — NK Patent Law, PLLC

(57) ABSTRACT

Disclosed herein is a device for being placed proximal a gutter downspout of a gutter channel. The device includes a cage assembly defining a bottom facing surface that engages with a bottom of the gutter channel when installed within the channel, a rear facing surface that engages a rear surface of the gutter channel when installed within the channel, a top facing surface not in engagement with the gutter channel when installed within the channel, a front facing surface that defines a generally vertical surface that engages a front surface of the gutter channel and a generally diagonal surface that engages a correspondingly diagonal surface of the front portion of the gutter channel. The cage assembly defines one or more openings sized to allow flowthrough of liquid into the device and inhibit flowthrough of debris into the device.

7 Claims, 11 Drawing Sheets

PERSPECTIVE IN GUTTER

FRONT VIEW IN GUTTER
w/gutter cut away
showing water flow and leaf/debris build up in gutter

PERSPECTIVE INSTALLED

FRONT VIEW
(when set in gutter facing away from building)
13" long x 3.5" high x 4.25"deep BOTTOM VIEW
(front facing down)

BACK VIEW
(bottom side down)

PERSPECTIVE VIEW
(front facing to the left)

SIDE VIEW - LEFT END
(front facing to the right)

LARGE VERSION
(left end, front facing right)

SMALL VERSION
(right end, front facing left)

DEVICE FOR FILTERING DEBRIS IN A GUTTER DOWNSPOUT AND RELATED METHOD

CROSS REFERENCE TO RELATED APPLICATIONS

This application claims the benefit of U.S. Provisional Application 61/974,403 filed Apr. 2, 2014, which is incorporated herein by reference in its entirety.

TECHNICAL FIELD

This application is directed towards a device for filtering debris in a gutter downspout and a related method. More particularly, this application is directed towards a device that is selectively positionable about a downspout opening and maintains a predetermined amount of spacing between collected debris and the downspout opening.

BACKGROUND

Gutter assemblies are used for channeling precipitation collected on a roof top and then transferring that precipitation to some proximal location. The purposes of these assemblies are to keep precipitation from running off the roof of a structure where this may cause damage and flooding of the underlying ground structure.

Gutter assemblies include a gutter channel that runs generally horizontally along an edge of a roof. Water collects into the gutter channel and then flows towards a downspout that transports the water from the roof to a nearby ground surface.

Gutter assemblies are susceptible to collecting leaves and other debris. This is particularly problematic in the Fall season where trees shed their leaves. Many times, the leaves collect on the rooftop and then precipitation sweeps the leaves into the gutter assembly. Other debris such as pine needles and the like may also collect on the rooftop. Once the precipitation sweeps the leaves and debris into the gutter assembly, the leaves must be removed before the gutter assembly is blocked and precipitation cannot flow through the gutter assembly. Cleaning of the horizontal channels is accomplished by removing the material from the channels by hand, or by pressurization including a water gun or a blower. Since the horizontal channels are typically exposed on a top surface, cleaning of these channels is relatively easy, however, the vertically extending downspouts are not exposed in a manner where they are easily cleaned and, in some instances, must be removed from the gutter assembly for cleaning and then re-installed.

There is a need for a device or method to address these disadvantages.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Disclosed herein is a device for being placed proximal a gutter downspout of a gutter channel. The device includes a cage assembly defining a bottom facing surface that engages with a bottom of the gutter channel when installed within the channel, a rear facing surface that engages a rear surface of the gutter channel when installed within the channel, a top facing surface not in engagement with the gutter channel when installed within the channel, a front facing surface that defines a generally vertical surface that engages a front surface of the gutter channel and a generally diagonal surface that engages a correspondingly diagonal surface of the front portion of the gutter channel, and a pair of opposing side surfaces engaged with each of the bottom facing surface, rear facing surface, top facing surface, and front facing surface. The cage assembly defines one or more openings on at least each of the opposing side surfaces and the top surface thereof, the one or more openings sized to allow flowthrough of liquid into the device and inhibit flowthrough of debris into the device.

According to one or more embodiments, the device is formed from a wire frame structure.

According to one or more embodiments, a channel is defined between the generally vertical surface and the generally diagonal surface of the front facing surface to allow flowthrough of liquid in the channel but not substantially into the device.

According to one or more embodiments, the bottom facing surface defines one or more openings to allow flowthrough of liquid from within the device into the proximal downspout.

According to one or more embodiments, the top facing surface does not extend above the top of the gutter channel when the device is installed within the gutter channel such that, when debris collects about one of the opposing side surfaces and the liquid level rises above the top facing surface, liquid flows into the device through the top facing surface.

According to one or more embodiments, a method of filtering liquid that flowsthrough a gutter downspout is provided. The method includes placing the device disclosed herein in the gutter channel and spanning the opening of the gutter downspout.

According to one or more embodiments, a method of filtering liquid that flowsthrough a gutter downspout is provided. The method includes determining a height of the gutter channel, selecting a device disclosed herein, where the height of the device is less than the height of the gutter channel, and placing the device in the gutter channel such that the device spans the opening of the gutter downspout.

According to one or more embodiments, a method of forming the device disclosed herein is provided. The method includes providing a panel of wire frame material, forming the panel around a mold to define each of the bottom facing surface, rear facing surface, front facing surface, and top facing surface to form an elongate enclosure, and forming end surfaces and engaging them with respective ends of the elongate enclosure.

BRIEF DESCRIPTION OF THE DRAWINGS

The foregoing summary, as well as the following detailed description of various embodiments, is better understood when read in conjunction with the appended drawings. For the purposes of illustration, there is shown in the drawings exemplary embodiments; however, the presently disclosed subject matter is not limited to the specific methods and instrumentalities disclosed. In the drawings.

DETAILED DESCRIPTION

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

Figure 1:
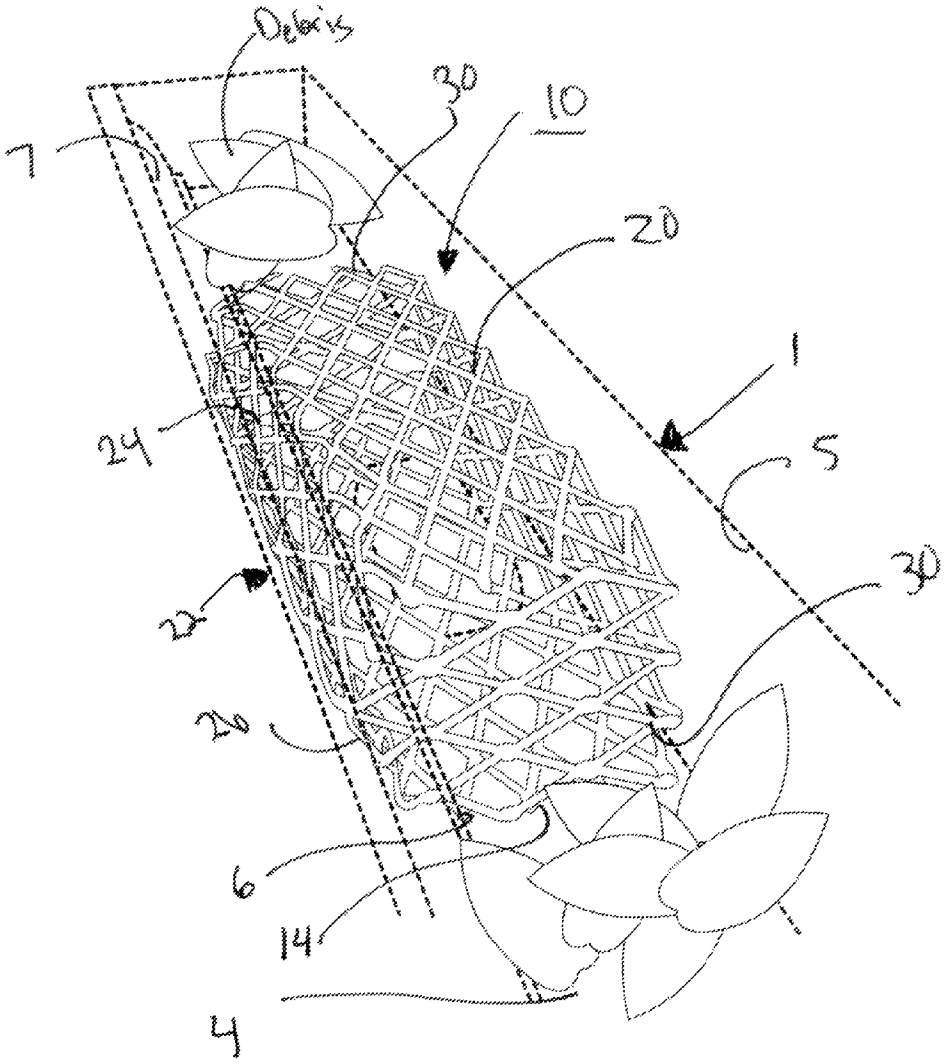
FIG. 1 illustrates a device for use with a gutter assembly, where the device is shown in a perspective view installed within the gutter assembly according to one or more embodiments disclosed herein.

FIG. 1 is a device 10 for use with a gutter assembly 1. In operation, the device 10 is placed proximal a gutter downspout 2 of a gutter channel 3. The device 10 includes a cage assembly 12 that may take on the embodiment as illustrated or may take on any shape, configuration, and construction capable of carrying out the functions described herein. The cage assembly 12 defines a bottom facing surface 14 that engages with a bottom 4 of the gutter channel 3 when the device 10 is installed within the channel 3. As used herein, surface does not necessarily denote a flat surface and instead refers to any section of material that defines a somewhat planar characteristic, including the grid-like structure illustrated in the drawings. The cage assembly 12 further defines a rear facing surface 16 that engages a rear surface 5 of the gutter channel 3 when the device 10 is installed within the channel 3. The cage assembly 12 further defines a top facing surface 20 that is not in engagement with the gutter channel 3 when the device 10 is installed within the channel 3. The cage assembly 12 further defines a front facing surface 22 that defines a generally vertical surface 24 that engages a front surface 6 of the gutter channel 3 when the device 10 is installed within the channel 3. Additionally, the front facing surface 22 defines a generally diagonal surface 26 that engages a correspondingly diagonal surface 7 of the front portion of the gutter channel 3. The cage assembly 12 further defines a pair of opposing side surfaces 30 engaged with each of the bottom facing surface 14, rear facing surface 16, top facing surface 20, and front facing surface 22 to form the cage assembly 12. The cage assembly 12 defines one or more openings 32 on at least each of the opposing side surfaces 30 and the top surface 20 of the cage assembly 12. In one or more embodiments, additional surfaces of the cage assembly 12 may define one or more openings. The one or more openings 32 are sized to allow flowthrough of liquid into the device 10 and inhibit flowthrough of debris into the device 10 and thus into a gutter downspout 2.

As illustrated, the cage assembly 12 may be formed from a wire frame structure. In this manner, the cage assembly 12 is durable, weather resistant, and efficiently manufactured. In one or more embodiments, cage assembly 12 may be formed from some other structure, including a polymer based material where the cage assembly 12 is injection molded.

In one or more embodiments, a channel 34 is defined between the generally vertical surface 24 and the generally diagonal surface 26 of the front facing surface 22 to allow flowthrough of liquid in the channel 34 but not substantially into the device 10. In this manner, if leaves or other debris have substantially blocked one of the opposing side surfaces 30, collected liquid may flowthrough channel 34 to prevent further collection of liquid in the gutter channel 3.

As illustrated, the bottom facing surface 14 may define one or more openings 32 to allow flowthrough of liquid from within the device 10 into the proximal downspout 2. In this manner, any liquid that flows into cage assembly 12 may then proceed to flow out of the one or more openings 32 positioned above the opening of the downspout 2 and into the downspout for transport away from the gutter assembly 1.

Figure 2:
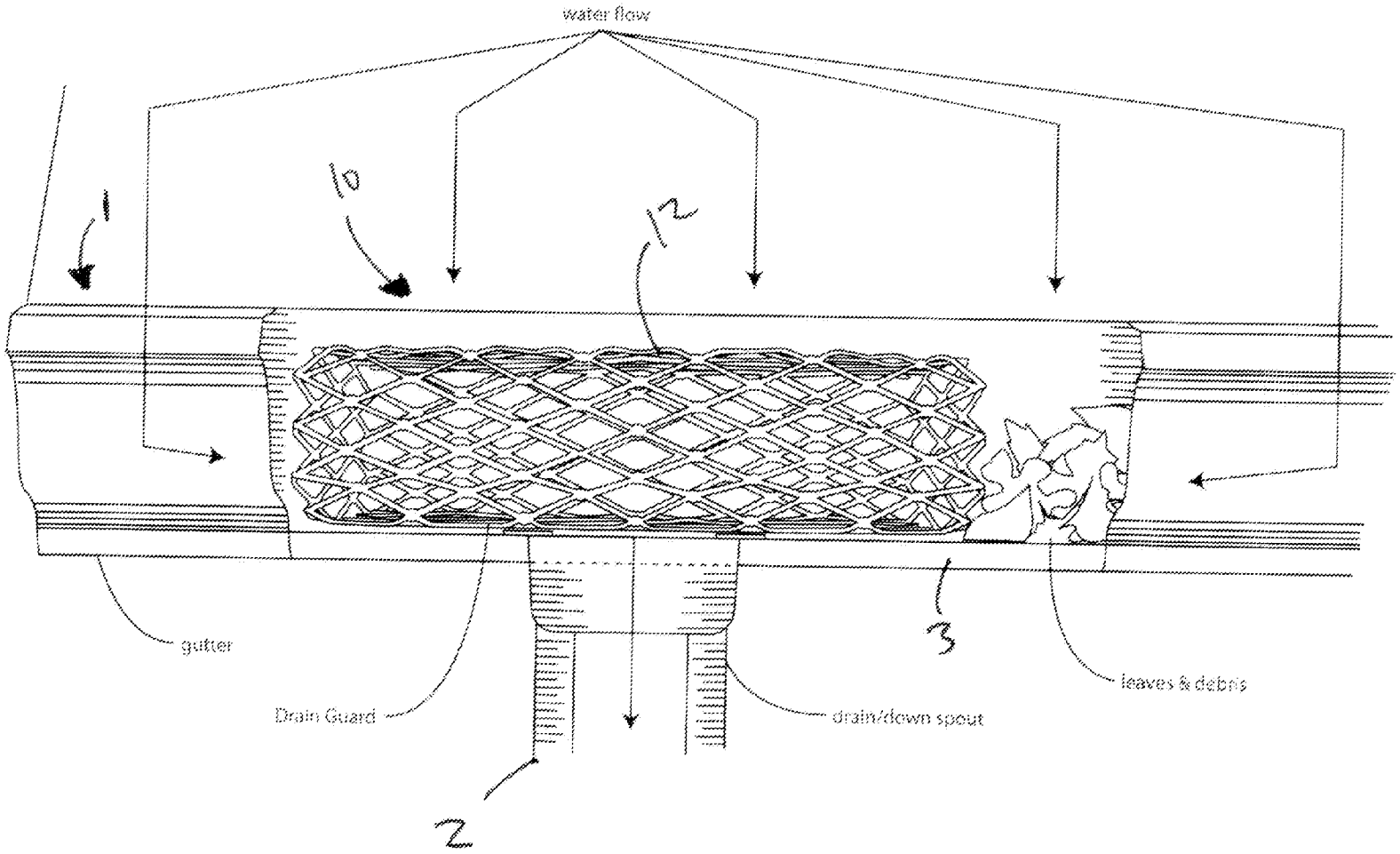
FIG. 2 illustrates a front, sectional view of the device installed within the gutter assembly according to one or more embodiments disclosed herein.
Figure 3:
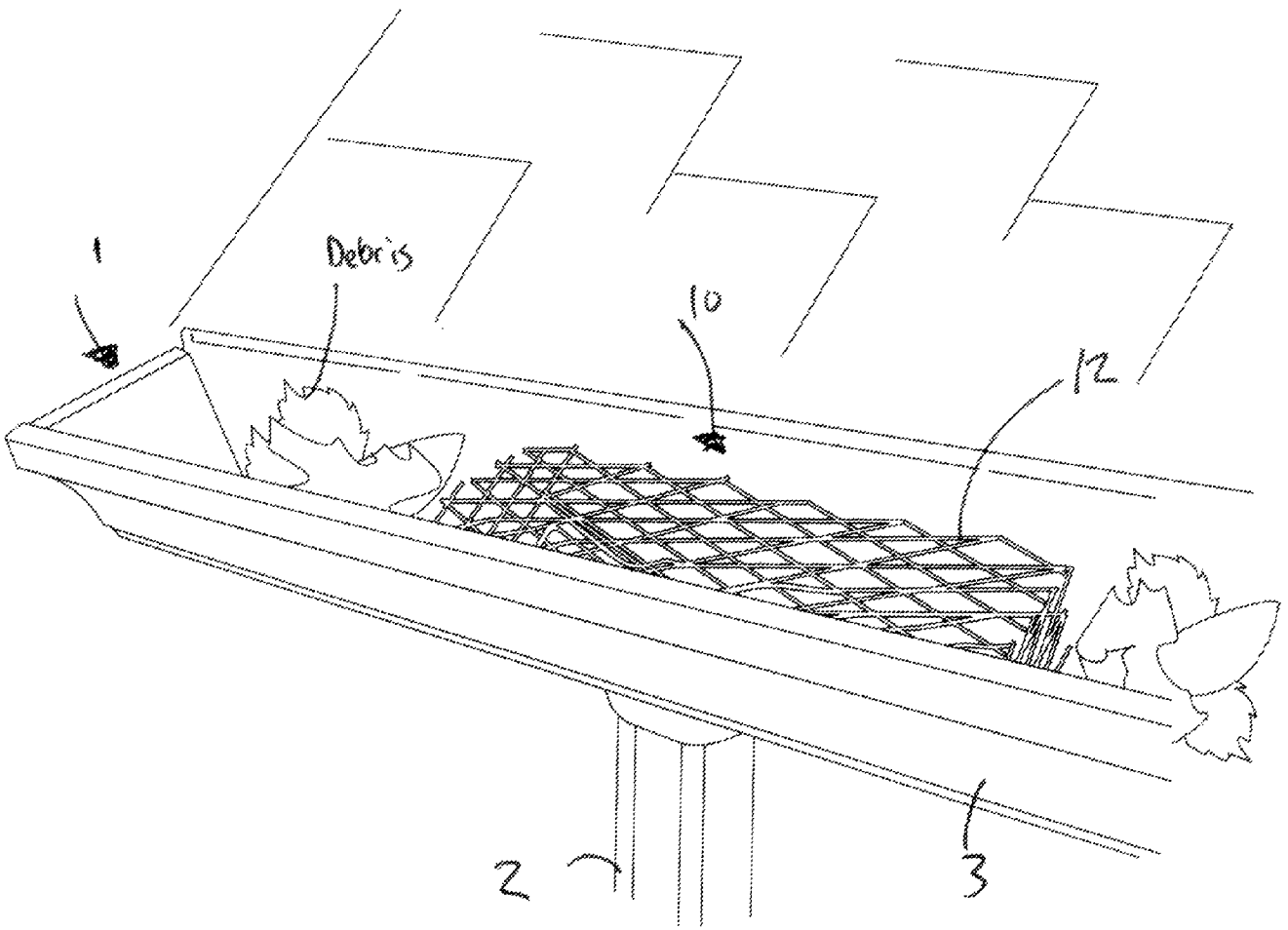
FIG. 3 illustrates a perspective view of the device installed within the gutter assembly according to one or more embodiments disclosed herein.
Figure 4:
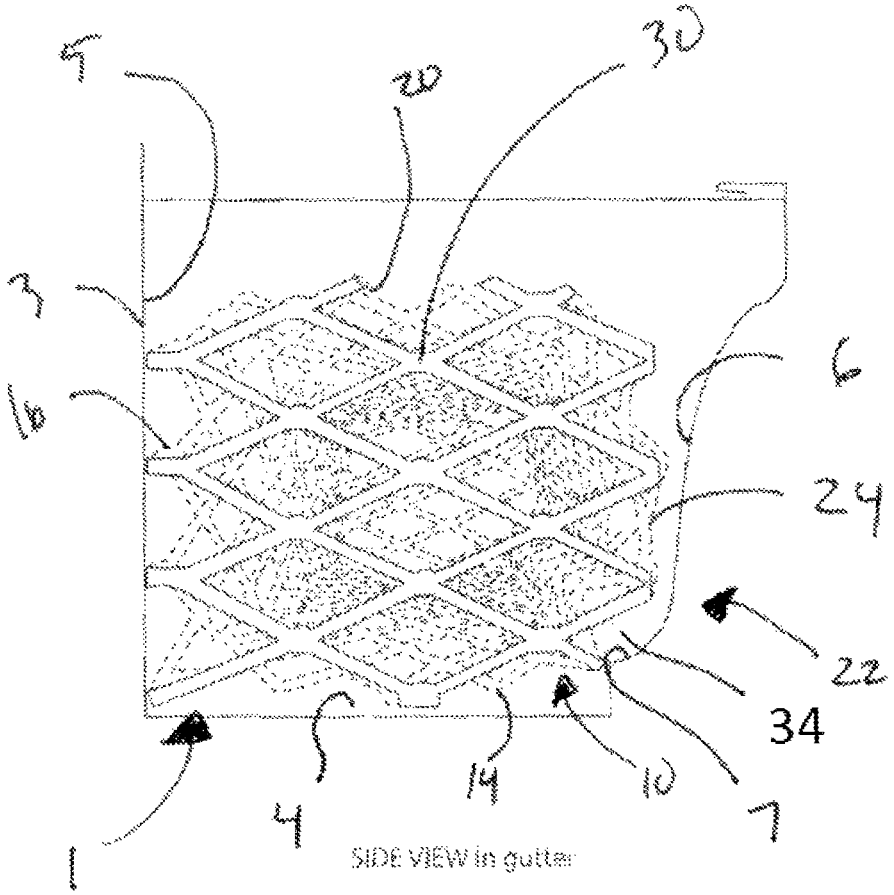
FIG. 4 illustrates a side view of the device installed within the gutter assembly according to one or more embodiments disclosed herein.
Figure 5:
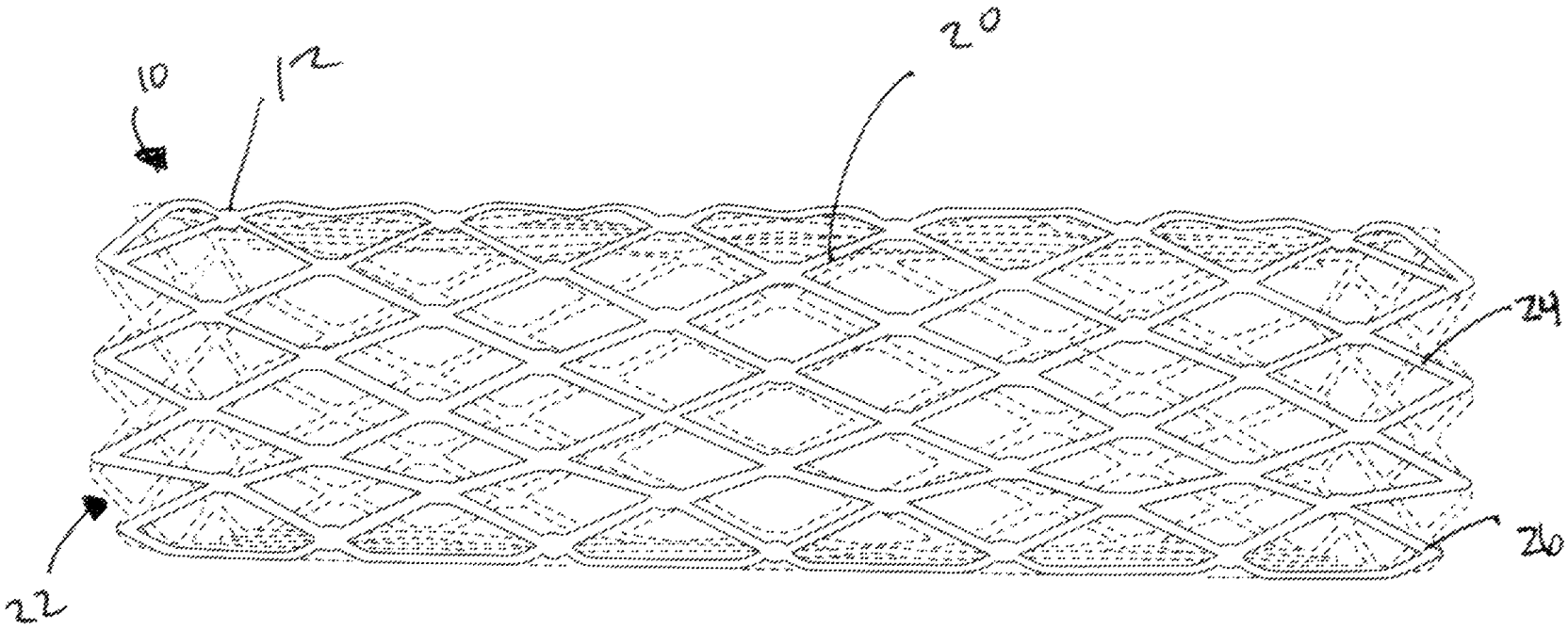
FIG. 5 illustrates a front view of the device according to one or more embodiments disclosed herein.
Figure 6:
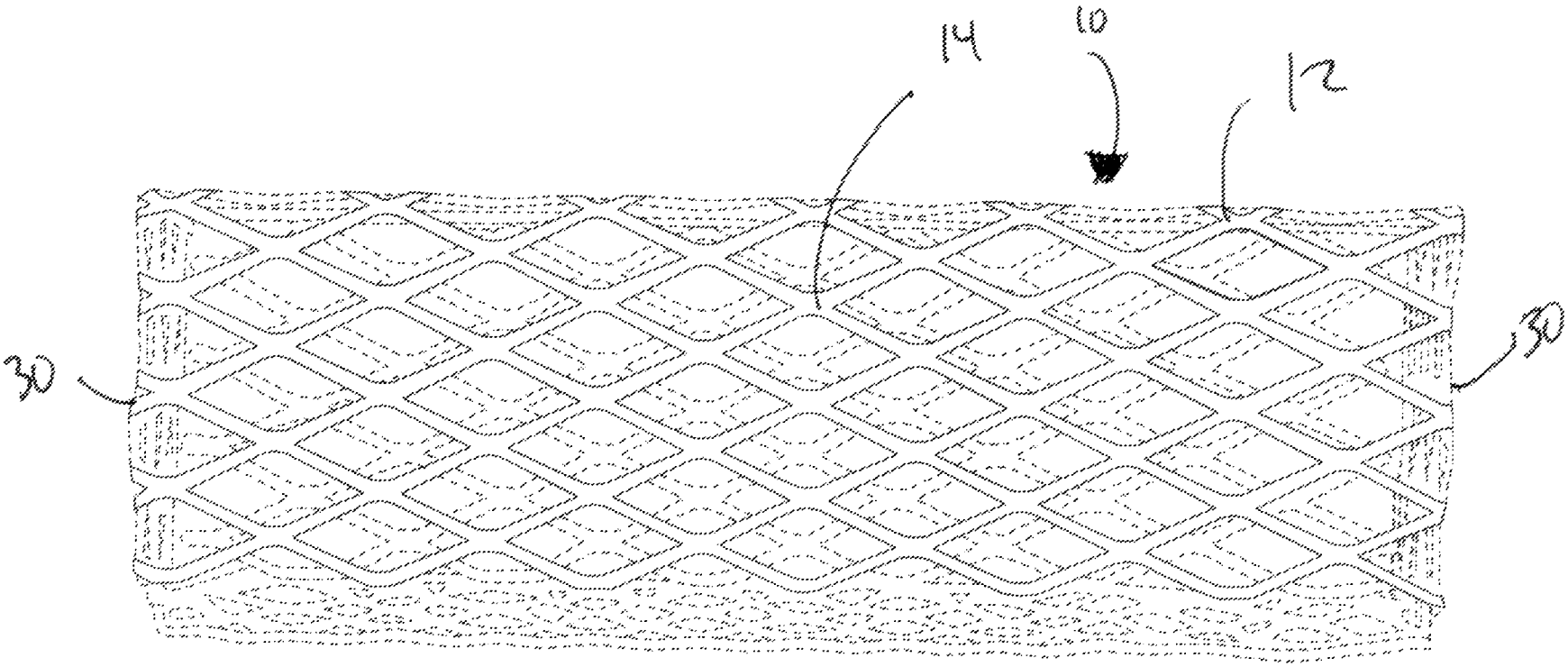
FIG. 6 illustrates a bottom view of the device according to one or more embodiments disclosed herein.
Figure 7:
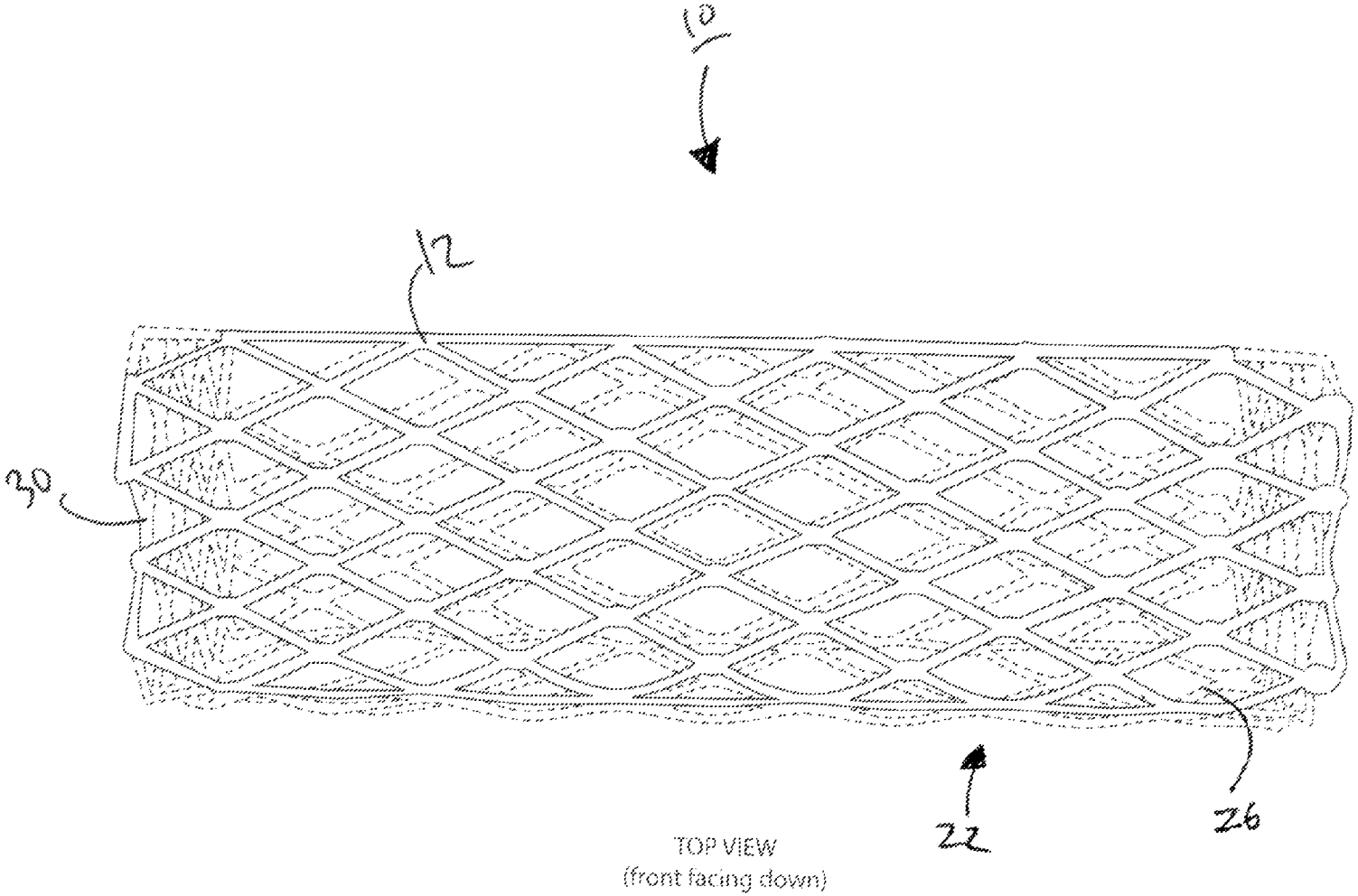
FIG. 7 illustrates a top view of the device according to one or more embodiments disclosed herein.
Figure 8:
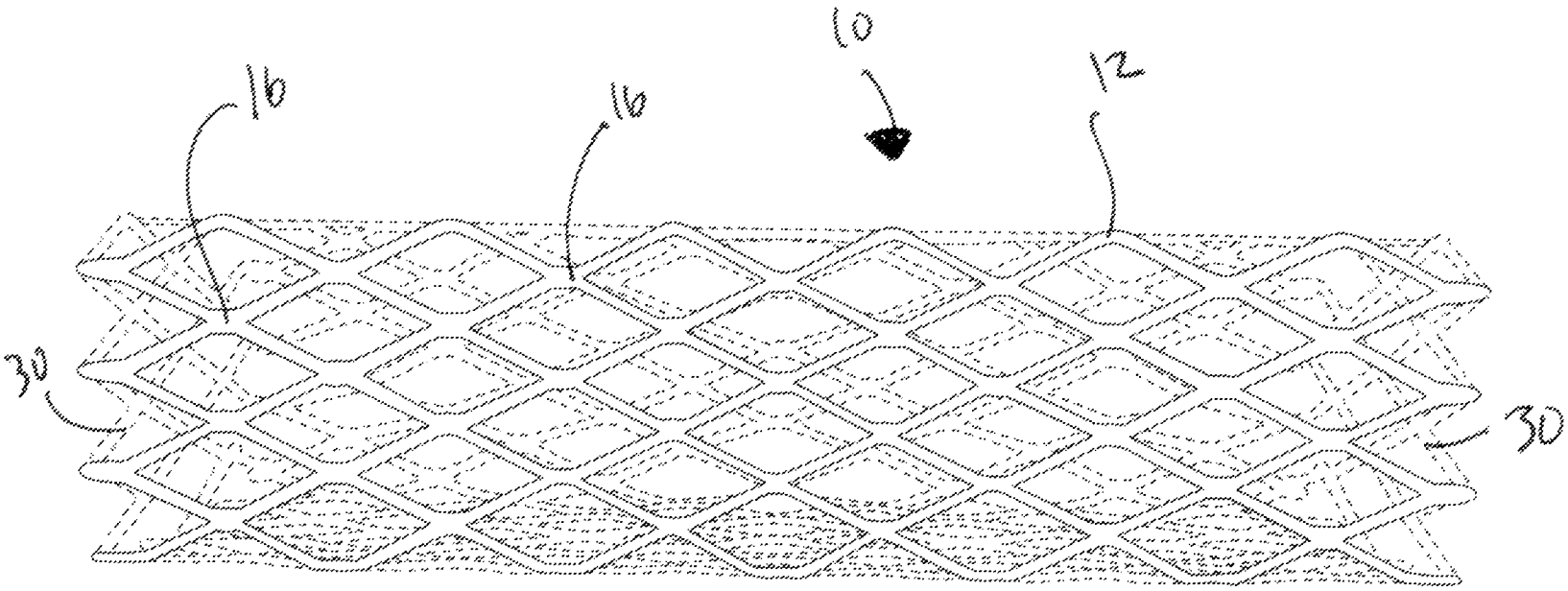
FIG. 8 illustrates a back view of the device according to one or more embodiments disclosed herein.
Figure 9:
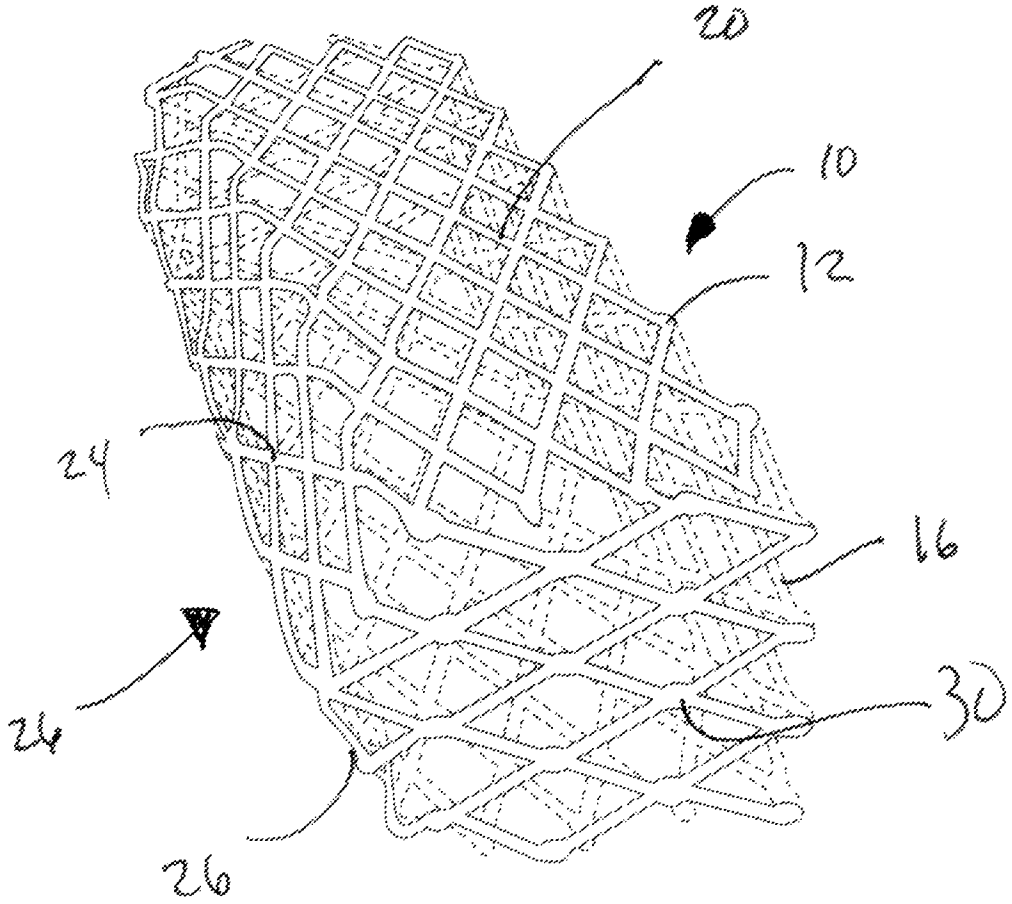
FIG. 9 illustrates a perspective view of the device according to one or more embodiments disclosed herein.
Figure 10:
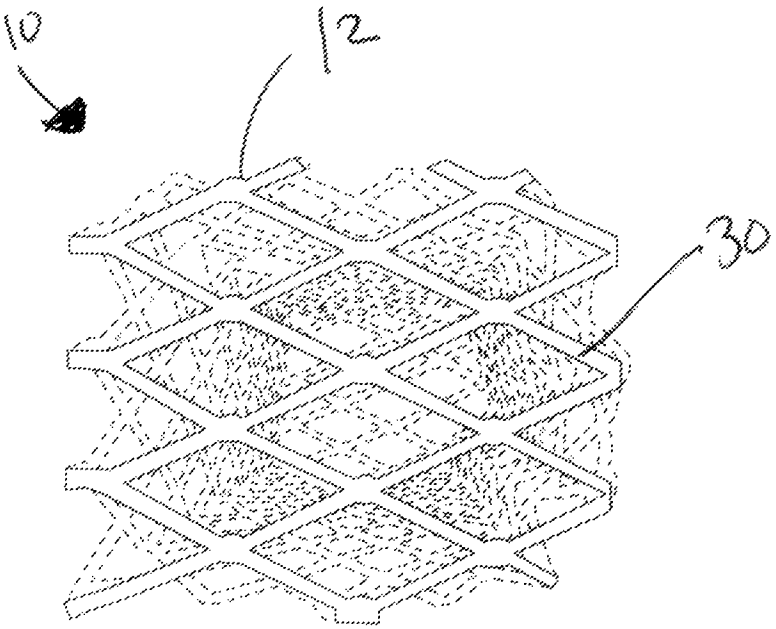
FIG. 10 illustrates a side view of the device according to one or more embodiments disclosed herein.

As illustrated well in FIG. 2, the device 10 is configured such that the top facing surface 20 does not extend above the top of the gutter channel 3 when the device 10 is installed within the gutter channel 3. In this manner, when debris collects about one of the opposing side surfaces 30 and the liquid level rises above the top facing surface 20, liquid flows into the device 10 through the one or more openings 32 of the top facing surface 20. The liquid then proceeds into the gutter downspout 2 for transport away from the gutter assembly. In this manner, even when there is a significant collection of debris.

A method of filtering liquid that flowsthrough a gutter downspout is provided. The method includes placing the device 10 in the gutter channel 3 and in a position where the device 10 spans the opening of the gutter downspout 2. This is well illustrated in FIG. 1 and FIG. 2. In this manner, collected debris always maintains a predetermined distance from the opening of the gutter downspout.

Figures 11, 12:
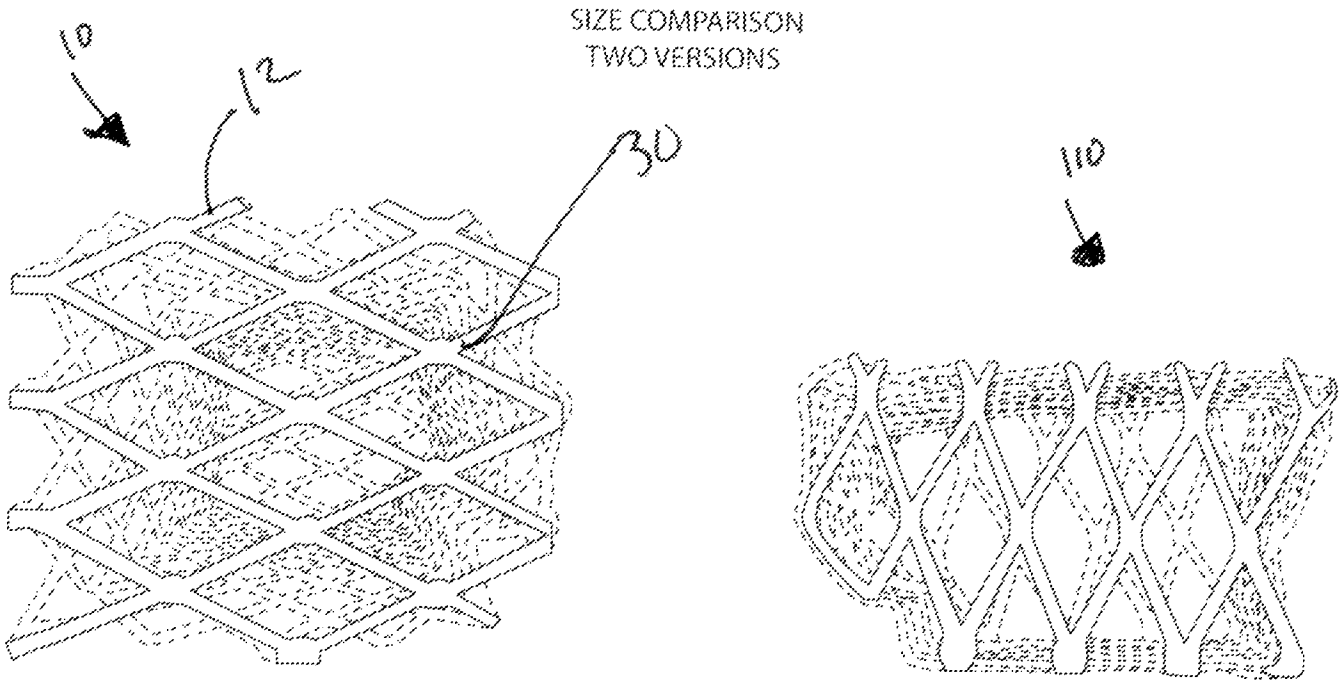
FIG. 11 illustrates a side view of the device according to one or more embodiments disclosed herein.
FIG. 12 illustrates a side view of a device having different dimensional characteristics according to one or more embodiments disclosed herein.

An additional method of filtering liquid that flowsthrough a gutter downspout is provided. The method includes determining a height of the gutter channel, selecting a device according to any device disclosed herein where the height of the device is less than the height of the gutter channel, and placing the device in the gutter channel such that the device spans the opening of the gutter downspout. This is illustrates well in FIG. 2. In this manner, when debris collects about one of the opposing side surfaces 30 and the liquid level rises above the top facing surface 20, liquid flows into the device 10 through the one or more openings 32 of the top facing surface 20. The liquid then proceeds into the gutter downspout 2 for transport away from the gutter assembly. Due to the height of the device being less than the height of the gutter channel, liquid can always flow through the top surface 20. For gutter channels of shorter heights, the shorter device shown in FIG. 12 may be employed.

A method of forming the device 10 may also be provided. The method may include providing a panel of wire frame material. The material is measured to determine overall dimensions such as height and width of the enclosure to be formed.

The method may further include forming the panel around a mold. The panel of material may be cut to the desired dimensions and after forming around the mold, each of the bottom facing surface, rear facing surface, front facing surface, and top facing surface are formed. Collectively, these surfaces form an elongate cage assembly/enclosure. The cage assembly may then be engaged such that terminal ends of the panel are joined together. The terminal ends may be engaged together by welding each respective end, or any other appropriately configured fastening method. The method may further include forming end surfaces and engaging them with respective ends of the elongate cage assembly/enclosure. The end surfaces may be pre-cut from the wire frame material and may be engaged with the cage assembly by welding or some other fastening method.

Features from one embodiment or aspect may be combined with features from any other embodiment or aspect in any appropriate combination. For example, any individual or collective features of method aspects or embodiments may be applied to apparatus, system, product, or component aspects of embodiments and vice versa.

While the embodiments have been described in connection with the various embodiments of the various figures, it is to be understood that other similar embodiments may be used or modifications and additions may be made to the described embodiment for performing the same function without deviating therefrom. Therefore, the disclosed embodiments should not be limited to any single embodiment, but rather should be construed in breadth and scope in accordance with the appended claims.

What is claimed:

1. A device for being placed proximal a gutter downspout of a gutter channel, the device comprising:

a cage assembly defining a bottom facing surface that engages with a bottom of the gutter channel when installed within the channel;

a rear facing generally planar surface that engages a rear surface of the gutter channel when installed within the gutter channel;

a top facing surface not in engagement with the gutter channel when installed within the channel;

a front facing surface that defines a generally vertical planar surface that defines a gap with a front surface of the gutter channel and a generally diagonal surface that engages a correspondingly diagonal surface of the front portion of the gutter channel, said generally diagonal surface connecting the bottom facing surface with the front facing surface, wherein the gap tapers along an entire length of the front facing surface such that the gap is larger at a topmost position of the front facing surface and smaller at a bottom position of the front facing surface; and a pair of opposing side surfaces engaged with each of the bottom facing surface, rear facing surface, top facing surface, and front facing surface, wherein the cage assembly defines one or more openings on at least each of the opposing side surfaces and the top surface thereof, the one or more openings sized to allow flowthrough of liquid into the device and inhibit flowthrough of debris into the device.

2. The device according to claim 1, wherein the device is formed from a wire frame structure.

3. The device according to claim 2, wherein a bypass channel is defined between the generally diagonal surface of the front facing surface and the front surface of the gutter channel when the device is installed within the gutter channel to allow flowthrough of liquid in the channel but not substantially into the device, wherein the bypass channel is further defined in the generally diagonal surface by a depression within a portion of the wireframe corresponding to the generally diagonal surface.

4. The device according to claim 1, wherein the bottom facing surface defines one or more openings to allow flowthrough of liquid from within the device into the proximal downspout.

5. The device according to claim 1, wherein the top facing surface does not extend above the top of the gutter channel when the device is installed within the gutter channel such that, when debris collects about one of the opposing side surfaces and the liquid level rises above the top facing surface, liquid flows into the device through the top facing surface.

6. A method of filtering liquid that flowsthrough a gutter downspout, the method comprising:

placing a device in the gutter channel, wherein the device includes:

a cage assembly defining a bottom facing surface that engages with a bottom of the gutter channel when installed within the channel;

a rear facing surface that engages a rear surface of the gutter channel when installed within the channel;

a top facing surface not in engagement with the gutter channel when installed within the channel;

a front facing surface that defines a generally vertical planar surface that defines a gap with a front surface of the gutter channel and a generally diagonal surface that engages a correspondingly diagonal surface of the front portion of the gutter channel, said generally diagonal surface connecting the bottom facing surface with the front facing surface, wherein the gap tapers along an entire length of the front facing surface such that the gap is larger at a topmost position of the front facing surface and smaller at a bottom position of the front facing surface;

and a pair of opposing side surfaces engaged with each of the bottom facing surface, rear facing surface, top facing surface, and front facing surface, wherein the cage assembly defines one or more openings on at least each of the opposing side surfaces and the top surface thereof, the one or more openings sized to allow flowthrough of liquid into the device and inhibit flowthrough of debris into the device; and spanning the opening of the gutter downspout.

7. The method of claim 6, further comprising:

determining a height of the gutter channel;

selecting the device where the height of the device is less than the height of the gutter channel; and placing the device in the gutter channel such that the device spans the opening of the gutter downspout.

* * * * *